US006247783B1

(12) United States Patent
Shibata et al.

(10) Patent No.: US 6,247,783 B1
(45) **Date of Patent: *Jun. 19, 2001**

(54) STORAGE AND SPITTOON SYSTEM FOR WASTE INKJET INK

(75) Inventors: Alan Shibata, Camas; Catherine Rotering, Vancouver, both of WA (US)

(73) Assignee: Hewlett-Packard Company, Palo Alto, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/007,446

(22) Filed: Jan. 15, 1998

(51) Int. Cl.[7] ..... B41J 2/165
(52) U.S. Cl. ..... 347/35; 347/36
(58) Field of Search ..... 347/35, 36, 33

(56) References Cited

U.S. PATENT DOCUMENTS

| | | | | |
|---|---|---|---|---|
| 4,144,537 | * | 3/1979 | Kimura et al. | 347/31 |
| 4,567,494 | | 1/1986 | Taylor | 346/140 R |
| 4,935,753 | | 6/1990 | Lehmann et al. | 346/140 |
| 5,027,134 | | 6/1991 | Harmon et al. | 346/140 R |
| 5,081,472 | | 1/1992 | Fisher | 346/140 |
| 5,103,244 | | 4/1992 | Gast et al. | 346/1.1 |
| 5,115,250 | | 5/1992 | Harmon et al. | 346/1.1 |
| 5,155,497 | | 10/1992 | Martin et al. | 346/1.1 |
| 5,617,124 | * | 4/1997 | Taylor et al. | 347/35 |

FOREIGN PATENT DOCUMENTS

| | | | |
|---|---|---|---|
| 59-45163 | 3/1984 | (JP) . | |
| 59-209876 | 11/1984 | (JP) | B41J/3/04 |

* cited by examiner

*Primary Examiner*—Huan Tran
*Assistant Examiner*—Shih-Wen Hsieh
(74) *Attorney, Agent, or Firm*—Flory L. Martin

(57) ABSTRACT

A storage and spittoon system is provided for an inkjet printing mechanism to handle waste inkjet ink that has been spit from an inkjet printhead during a nozzle clearing, purging or "spitting" routine. A rotating spit wheel has a rim with a concave cross sectional shape which receives ink residue spit from the printhead. A compliant scraper is spring biased to contact the spit wheel rim at a substantially tangential orientation to scrape the ink residue from the rim as the wheel is rotated past the scraper. The scraper directs the ink residue into a storage container as a string-like strip which is then packed to into a storage container as the spit wheel rotates. A method of purging ink residue from an inkjet printhead, along with an inkjet printing mechanism having such a waste ink storage and spittoon system, are also provided.

33 Claims, 7 Drawing Sheets

STORAGE AND SPITTOON SYSTEM FOR WASTE INKJET INK

FIELD OF THE INVENTION

The present invention relates generally to inkjet printing mechanisms, and more particularly to a storage and spittoon system for handling waste inkjet ink that has been spit from an inkjet printhead during a nozzle clearing, purging or "spitting" routine.

BACKGROUND OF THE INVENTION

Inkjet printing mechanisms use cartridges, often called "pens," which eject drops of liquid colorant, referred to generally herein as "ink," onto a page. Each pen has a printhead formed with very small nozzles through which the ink drops are fired. To print an image, the printhead is propelled back and forth across the page, ejecting drops of ink in a desired pattern as it moves. The particular ink ejection mechanism within the printhead may take on a variety of different forms known to those skilled in the art, such as those using piezo-electric or thermal printhead technology. For instance, two earlier thermal ink ejection mechanisms are shown in U.S. Pat. Nos. 5,278,584 and 4,683,481. In a thermal system, a barrier layer containing ink channels and vaporization chambers is located between a nozzle orifice plate and a substrate layer. This substrate layer typically contains linear arrays of heater elements, such as resistors, which are energized to heat ink within the vaporization chambers. Upon heating, an ink droplet is ejected from a nozzle associated with the energized resistor. By selectively energizing the resistors as the printhead moves across the page, the ink is expelled in a pattern on the print media to form a desired image (e.g., picture, chart or text).

To clean and protect the printhead, typically a "service station" mechanism is supported by the printer chassis so the printhead can be moved over the station for maintenance. For storage, or during non-printing periods, the service stations usually include a capping system which substantially seals the printhead nozzles from contaminants and drying. Some caps are also designed to facilitate priming, such as by being connected to a pumping unit that draws a vacuum on the printhead. During operation, clogs in the printhead are periodically cleared by firing a number of drops of ink through each of the nozzles in a process known as "spitting," with the waste ink being collected in a "spittoon" reservoir portion of the service station. After spitting, uncapping, or occasionally during printing, most service stations have an elastomeric wiper that wipes the printhead surface to remove ink residue, as well as any paper dust or other debris that has collected on the printhead. The wiping action is usually achieved through relative motion of the printhead and wiper, for instance by moving the printhead across the wiper, by moving the wiper across the printhead, or by moving both the printhead and the wiper.

As the inkjet industry investigates new printhead designs, the tendency is toward using permanent or semi-permanent printheads in what is known in the industry as an "off-axis" printer. In an off-axis system, the printheads carry only a small ink supply across the printzone, with this supply being replenished through tubing that delivers ink from an "off-axis"stationary reservoir placed at a remote stationary location within the printer. Narrower printheads may lead to a narrower printing mechanism, which has a smaller "footprint," so less desktop space is needed to house the printing mechanism during use. Narrower printheads are usually smaller and lighter, so smaller carriages, bearings, and drive motors may be used, leading to a more economical printing unit for consumers.

To improve the clarity and contrast of the printed image, recent research has focused on improving the ink itself. To provide quicker, more waterfast printing with darker blacks and more vivid colors, pigment-based inks have been developed. These pigment-based inks have a higher solid content than the earlier dye-based inks, which results in a higher optical density for the new inks. Both types of ink dry quickly, which allows inkjet printing mechanisms to form high quality images on readily available and economical plain paper, as well as on recently developed specialty coated papers, transparencies, fabric and other media. However, the combination of small nozzles and quick-drying ink leaves the printheads susceptible to clogging, not only from dried ink or minute dust particles, such as paper fibers, but also from the solids within the new inks themselves.

When spitting these new pigment-based inks onto the flat bottom of a conventional spittoon, over a period of time the rapidly solidifying waste ink grew into a stalagmite of ink residue. Eventually, in prototype units, the ink residue stalagmite grew to contact the printhead, which then either could interfere with printhead movement, print quality, or contribute to clogging the nozzles. Indeed, these stalagmites even formed ink deposits along the sides of the entranceway of prototype narrow spittoons, and eventually grew to meet one another and totally clog the entrance to the spittoon. To avoid this phenomenon, conventional spittoons had to be wide enough to handle these high solid content inks. This extra width increased the overall printer width, which then defeated the narrowing advantages realized by using an off-axis printhead system.

A ferris wheel spittoon system was disclosed in U.S. Pat. No. 5,617,124, currently assigned to the present assignee, the Hewlett-Packard Company. This system proposed an elastomeric ferris wheel as a spit surface. Ink residue was removed from the wheel with a rigid plastic scraper that was oriented along a radial of the wheel so the scraper edge approached the spitting surface at a substantially perpendicular angle. The scraper was located a short distance from the surface of the wheel, so it unfortunately could not completely clean the spitting surface. Furthermore, by locating the scraper a distance from the spit surface, the scraper was ineffective in removing any liquid ink residue from the wheel. This earlier ferris wheel spittoon system failed to provide for adequate storage of the ink residue after removal from the Ferris wheel during the desired lifespan of a printer. Thus, it would be desirable to have a spittoon system which defeats ink residue stalagmite build-up, and provides for ink residue storage during the lifespan of the inkjet printing unit.

SUMMARY OF THE INVENTION

According to one aspect of the present invention, a spittoon system is provided for receiving ink residue spit from an inkjet printhead in an inkjet printing mechanism. The spittoon system includes a rotatable spit wheel having a rim located to receive ink residue spit from the inkjet printhead, along with a rotating device that selectively rotates the spit wheel. A scraper presses against the rim of the spit wheel to scrape ink residue from the rim when the spit wheel is rotated by the rotating device. The spittoon system also has a storage container that defines a chamber to store the ink residue after removal from the spit wheel rim by the scraper.

According to a another aspect of the present invention, a method of purging ink residue from an inkjet printhead in an inkjet printing mechanism is provided. This method includes the step of providing a scraper, a storage container, and a rotatable spit wheel having a rim. In a spitting step, ink residue is spit or purged from the printhead onto the spit wheel rim. The method also includes the steps of rotating the spit wheel, and scraping ink residue from the spit wheel rim during the rotating step. Finally, in a packing step, the ink residue is packed into a storage container after the scraping step.

According to a further aspect of the present invention, an inkjet printing mechanism may be provided with a storage and spittoon system for handling waste inkjet ink as described above.

An overall goal of the present invention is to provide an inkjet printing mechanism which prints sharp vivid images over the life of the printhead and the printing mechanism.

Still another goal of the present invention is to provide a storage and spittoon system that efficiently removes the waste ink residue from a spitting surface and then stores this residue over the expected lifespan of an inkjet printing mechanism.

Another goal of the present invention is to provide a long-life spittoon system for receiving ink spit from printheads in an inkjet printing mechanism to provide consumers with a reliable, robust inkjet printing unit.

BRIEF DESCRIPTION OF THE DRAWINGS

FIGS. 2 and 3 are perspective views of the service station of FIG. 1, showing the location of an inkjet printhead over the storage and spittoon system during a spitting routine, specifically, with:

FIG. 2 being a rear perspective view; and

FIG. 3 being a front perspective view, with a printhead carriage portion of the inkjet printer being omitted for clarity.

FIGS. 4 and 5 are exploded views of a spittoon wheel portion of the storage and spittoon system of FIG. 1, specifically, with:

FIG. 4 being an inboard side view; and

FIG. 5 being an outboard side view.

DETAILED DESCRIPTION OF A PREFERRED EMBODIMENT

Figure 1:
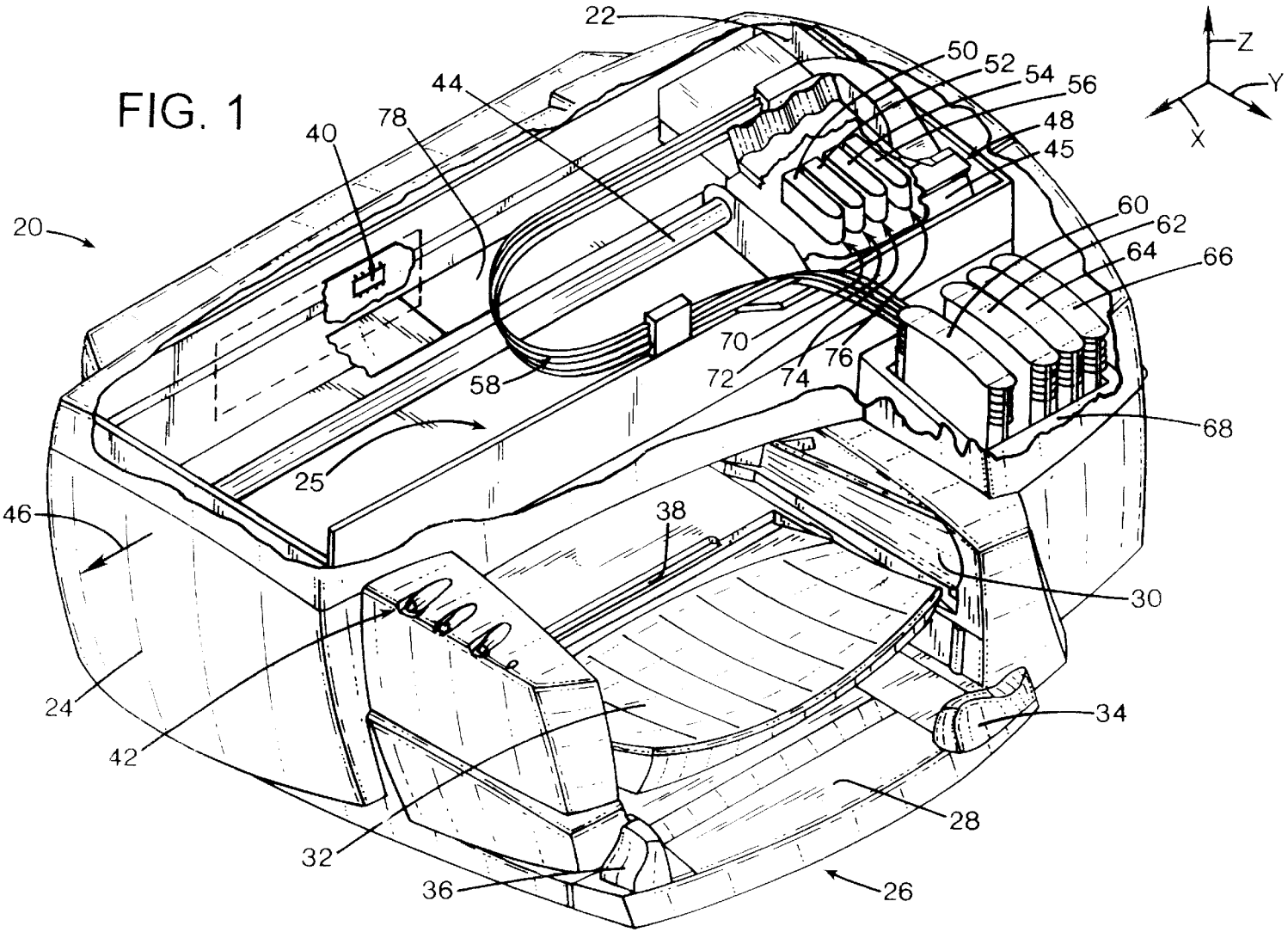
FIG. 1 is a perspective view of one form of an inkjet printing mechanism, here, an inkjet printer, including a printhead service station having one form of a storage and spittoon system of the present invention for servicing inkjet printheads.

FIG. 1 illustrates an embodiment of an inkjet printing mechanism, here shown as an "off-axis" inkjet printer 20, constructed in accordance with the present invention, which may be used for printing for business reports, correspondence, desktop publishing, and the like, in an industrial, office, home or other environment. A variety of inkjet printing mechanisms are commercially available. For instance, some of the printing mechanisms that may embody the present invention include plotters, portable printing units, copiers, cameras, video printers, and facsimile machines, to name a few, as well as various combination devices, such as a combination facsimile/printer. For convenience the concepts of the present invention are illustrated in the environment of an inkjet printer 20.

While it is apparent that the printer components may vary from model to model, the typical inkjet printer 20 includes a frame or chassis 22 surrounded by a housing, casing or enclosure 24, typically of a plastic material. Sheets of print media are fed through a printzone 25 by a media handling system 26. The print media may be any type of suitable sheet material, such as paper, card-stock, transparencies, photographic paper, fabric, mylar, and the like, but for convenience, the illustrated embodiment is described using paper as the print medium. The media handling system 26 has a feed tray 28 for storing sheets of paper before printing. A series of conventional paper drive rollers driven by a stepper motor and drive gear assembly (not shown), may be used to move the print media from the input supply tray 28, through the printzone 25, and after printing, onto a pair of extended output drying wing members 30, shown in a retracted or rest position in FIG. 1. The wings 30 momentarily hold a newly printed sheet above any previously printed sheets still drying in an output tray portion 32, then the wings 30 retract to the sides to drop the newly printed sheet into the output tray 32. The media handling system 26 may include a series of adjustment mechanisms for accommodating different sizes of print media, including letter, legal, A-4, envelopes, etc., such as a sliding length adjustment lever 34, a sliding width adjustment lever 36, and an envelope feed port 38.

The printer 20 also has a printer controller, illustrated schematically as a microprocessor 40, that receives instructions from a host device, typically a computer, such as a personal computer (not shown). The printer controller 40 may also operate in response to user inputs provided through a key pad 42 located on the exterior of the casing 24. A monitor coupled to the computer host may be used to display visual information to an operator, such as the printer status or a particular program being run on the host computer. Personal computers, their input devices, such as a keyboard and/or a mouse device, and monitors are all well known to those skilled in the art.

A carriage guide rod 44 is supported by the chassis 22 to slidably support an off-axis inkjet pen carriage system 45 for travel back and forth across the printzone 25 along a scanning axis 46. The carriage 45 is also propelled along guide rod 44 into a servicing region, as indicated generally by arrow 48, located within the interior of the housing 24. A conventional carriage drive gear and DC (direct current) motor assembly may be coupled to drive an endless belt (not shown), which may be secured in a conventional manner to the carriage 45, with the DC motor operating in response to control signals received from the controller 40 to incrementally advance the carriage 45 along guide rod 44 in response to rotation of the DC motor. To provide carriage positional feedback information to printer controller 40, a conventional encoder strip may extend along the length of the printzone 25 and over the service station area 48, with a conventional optical encoder reader being mounted on the back surface of printhead carriage 45 to read positional information provided by the encoder strip. The manner of providing positional feedback information via an encoder strip reader may be accomplished in a variety of different ways known to those skilled in the art.

Figure 2:
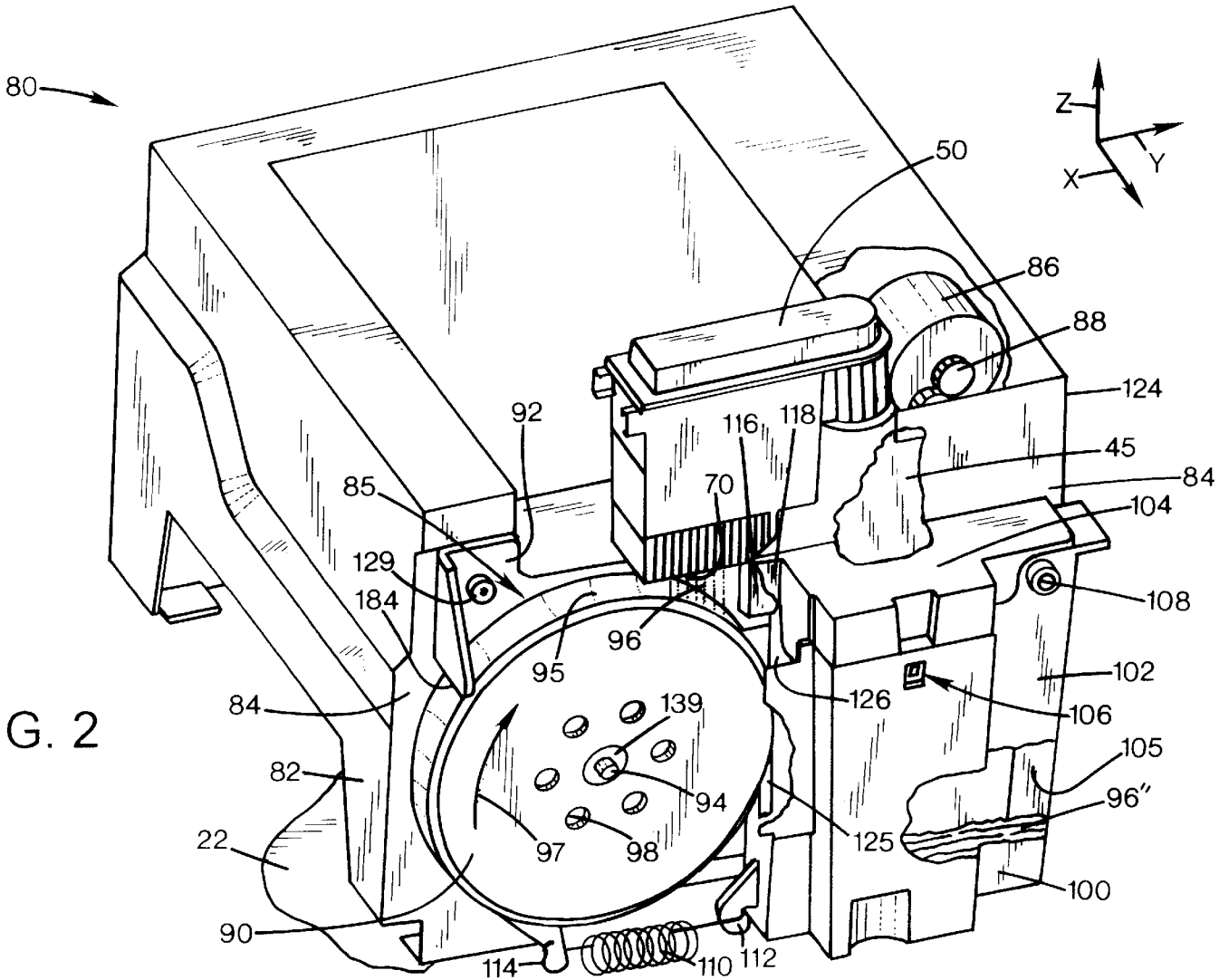
Figure 3:
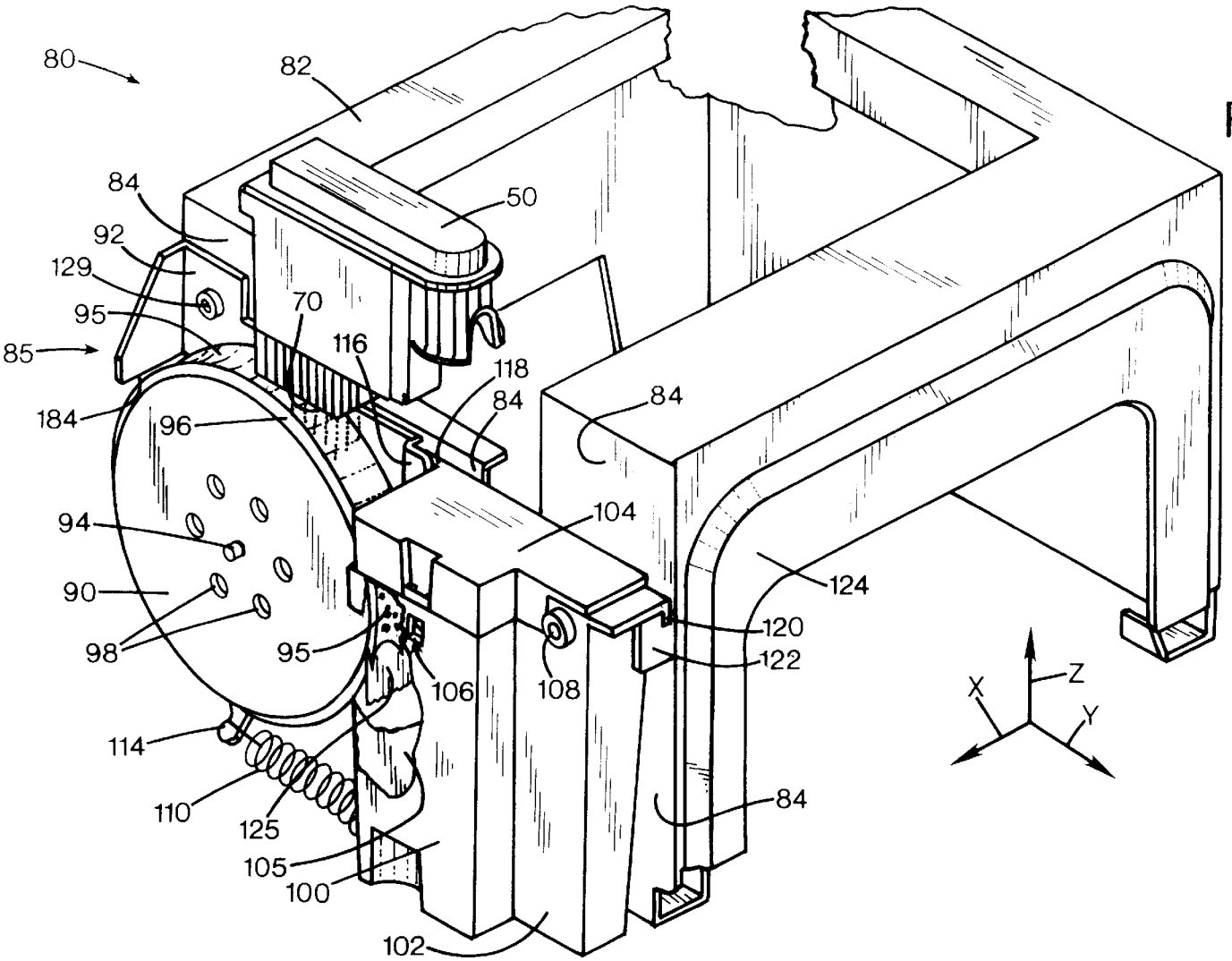
Figure 4:
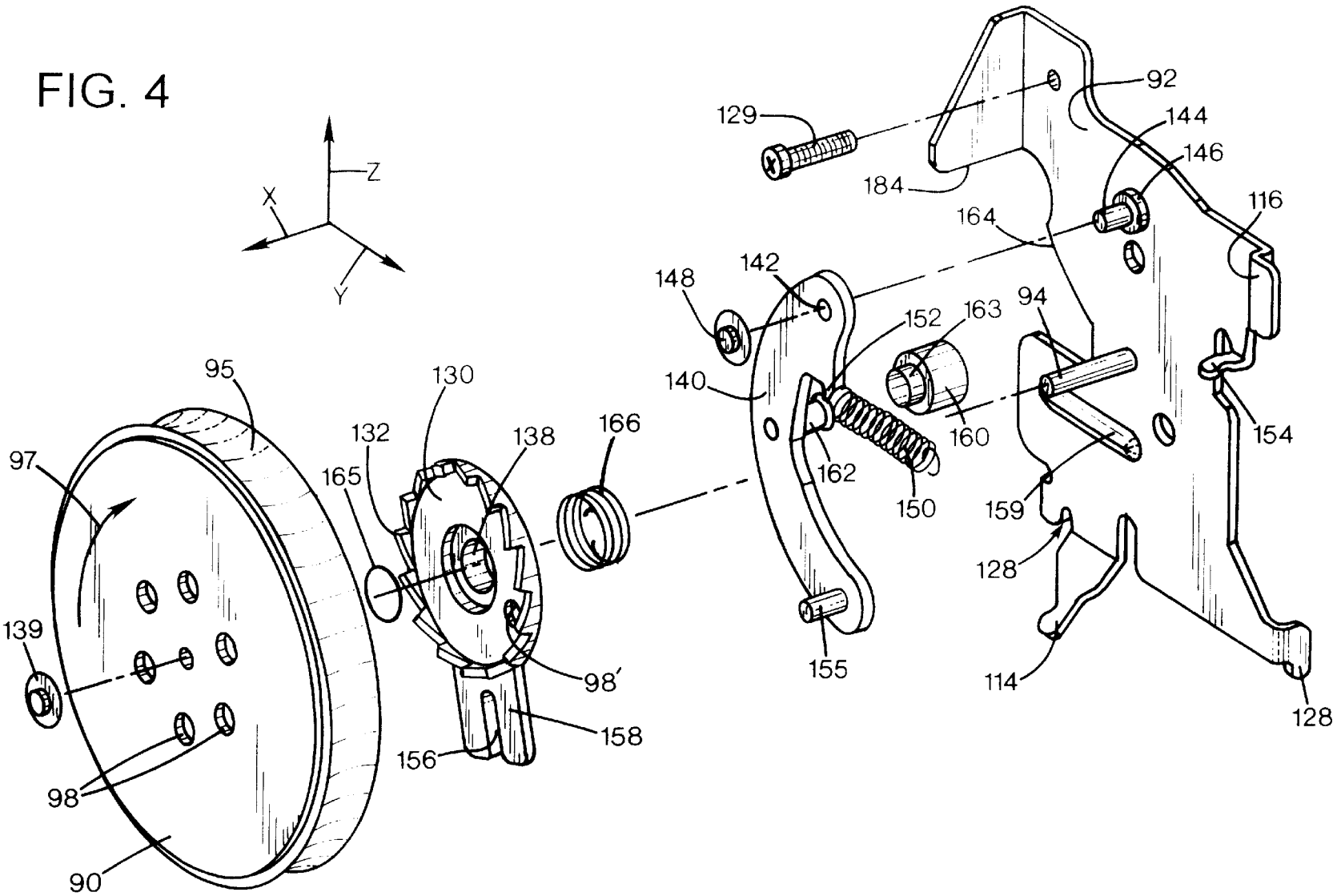

In the printzone 25, the media sheet 34 receives ink from an inkjet cartridge, such as a black ink cartridge 50 and three monochrome color ink cartridges 52, 54 and 56, shown schematically in FIG. 2. The cartridges 50–56 are also often called "pens" by those in the art. The black ink pen 50 is illustrated herein as containing a pigment-based ink. While the illustrated color pens 52–56 each contain a dye-based ink of the colors cyan, magenta and yellow, respectively. In FIGS. 3 and 4, the cyan pen 52 is also indicated by the letter "C," the magenta pen 54 by the letter "M," the yellow pen 56 by the letter "Y," and the black pen 50 by the letter "K," which are standard color designations in the field of inkjet printing. It is apparent that other types of inks may also be used in pens 50–56, such as paraffin-based inks, as well as hybrid or composite inks having both dye and pigment characteristics.

The illustrated pens 50–56 each include small reservoirs for storing a supply of ink in what is known as an "off-axis" ink delivery system, which is in contrast to a replaceable cartridge system where each pen has a reservoir that carries the entire ink supply as the printhead reciprocates over the printzone 25 along the scan axis 46. Hence, the replaceable cartridge system may be considered as an "on-axis" system, whereas systems which store the main ink supply at a stationary location remote from the printzone scanning axis are called "off-axis" systems. In the illustrated off-axis printer 20, ink of each color for each printhead is delivered via a conduit or tubing system 58 from a group of main stationary reservoirs 60, 62, 64 and 66 to the on-board reservoirs of pens 50, 52, 54 and 56, respectively. The stationary or main reservoirs 60–66 are replaceable ink supplies stored in a receptacle 68 supported by the printer chassis 22. Each of pens 50, 52, 54 and 56 have printheads 70, 72, 74 and 76, respectively, which selectively eject ink to from an image on a sheet of media in the printzone 25. The concepts disclosed herein for cleaning the printheads 70–76 apply equally to the totally replaceable inkjet cartridges, as well as to the illustrated off-axis semi-permanent or permanent printheads, although the greatest benefits of the illustrated system may be realized in an off-axis system where extended printhead life is particularly desirable.

The printheads 70, 72, 74 and 76 each have an orifice plate with a plurality of nozzles formed therethrough in a manner well known to those skilled in the art. The nozzles of each printhead 70–76 are typically formed in at least one, but typically two linear arrays along the orifice plate. Thus, the term "linear" as used herein may be interpreted as "nearly linear" or substantially linear, and may include nozzle arrangements slightly offset from one another, for example, in a zigzag arrangement. Each linear array is typically aligned in a longitudinal direction perpendicular to the scanning axis 46, with the length of each array determining the maximum image swath for a single pass of the printhead. The illustrated printheads 70–76 are thermal inkjet printheads, although other types of printheads may be used, such as piezoelectric printheads. The thermal printheads 70–76 typically include a plurality of resistors which are associated with the nozzles. Upon energizing a selected resistor, a bubble of gas is formed which ejects a droplet of ink from the nozzle and onto a sheet of paper in the printzone 25 under the nozzle. The printhead resistors are selectively energized in response to firing command control signals delivered by a multi-conductor strip 78 from the controller 40 to the printhead carriage 45.

Storage And Spittoon System For Handling Waste Inkjet Ink

FIG. 2 illustrates one form of a service station 80 constructed in accordance with the present invention for servicing the black and color printheads 70–76. The service station 80 has a main frame 82 that is supported by the printer chassis 22 in the servicing region 48 within the printer casing 24. The service station 80 supports a variety of printhead servicing appliances (not shown) such as printhead caps and printhead wipers, which are not the subject of this invention. The service station frame 82 has an inboard sidewall 84 which supports a waste ink storage and spittoon system 85, constructed in accordance with the present invention as a portion of the service station 80 for handling waste inkjet ink deposited in particular by the black printhead 70. The service station 80 may also include a conventional absorbent color ink spittoon (not shown) to receive ink spit from the color printheads 72–76.

The service station 80 also includes a motor 86 that is coupled to drive a gear assembly 88, which in turn is coupled through a mechanism described further below to drive a spittoon wheel portion 90 of the ink storage and spittoon system 85. The motor 86 rotates in response to control signals received from the printer controller 40. The system 85 includes a spittoon wheel support member or bracket 92 which is supported by the service station frame sidewall 84. A spindle or axle 94 projects outwardly from the support bracket 92 to rotationally support the spit wheel 90. The spit wheel 90 has an outer rim, which preferably has a concave shaped cross section, to serve as a spit platform for receiving waste ink spit 96 from the black printhead 70. Preferably, the spit wheel 90 is mounted to receive the ink spit 96 along a descending portion thereof, as the wheel 90 is rotated in the direction of arrow 97. The spit wheel 90 also defines a series of alignment holes, such as hole 98, which are used during the assembly of the service station 80 to optically verify spittoon wheel operation. Preferably, the spit wheel 90 is constructed of an ink-resistant, non-wetting material with dimensional stability, such as a glass fiber filled nylon material.

Another main component of the ink storage and spittoon system 85 is an ink residue storage container or bucket 100, which has a hollow body 102 and a cover portion 104, which is preferably transparent. The spit wheel 90 rotates to transport ink deposited thereon into the container 100 where the liquid components of the ink waste ink evaporate and the remaining solid ink residuals are permanently stored. Together, the container body 102 and cover 104 define a chamber 105 therein for receiving and storing this partially dried and liquid ink spit residue 96' from the printhead 70. Optionally, an absorbent pad (not shown) may be placed within the storage chamber 105 to absorb ink residue liquid components until they eventually evaporate. The cover portion 104 may be secured to the container body 102, such as by bonding, or other means, and in the illustrated embodiment using a pair of snap fit attachments, such as attachment 106. The container body 102 is pivotally mounted to the service station frame sidewall 84 at a pivot post 108 projecting outwardly from wall 84. The container 100 pivots around post 108 and is resiliently pulled toward of the spit wheel 90 by a biasing member, such as a tension spring 110 which joins a mounting member 112 that extends from the body 102 to a mounting tab portion 114 of the support bracket 92.

The spit wheel support bracket 92 also includes a second mounting tab 116 which defines a pocket between tab 116 and the service station sidewall 84. The container cover 104 has a finger portion 118 projecting therefrom which is received in this pocket defined by tab 116. As best shown in FIG. 3, the container body 102 has another mounting member portion 120 projecting therefrom which is received within a notch defined by a mounting member 122 that extends from a front wall 124 of the service station frame 82. Advantageously, through the use of the interlocking mounting tabs 116, 118 and 120, 122, no retainer is required at the pivot post 108, because tabs 116, 118 and 120, 122 secure container 100 from movement in the positive X-axis direction. Another main component of the storage and spittoon system 85 is a compliant spit wheel scraper 125, which is mounted beneath an entrance portal 126 to the chamber 105, with the entrance portal 126 being defined by the container body 102 and cover 104. Preferably, the scraper 125 is constructed of an ink-resistant, non-wetting material, such as a low density polyethylene that is soft enough to have a compliant nature that allows the scraper 125 to conform to the concave contour of the wheel rim 95.

Figure 5:
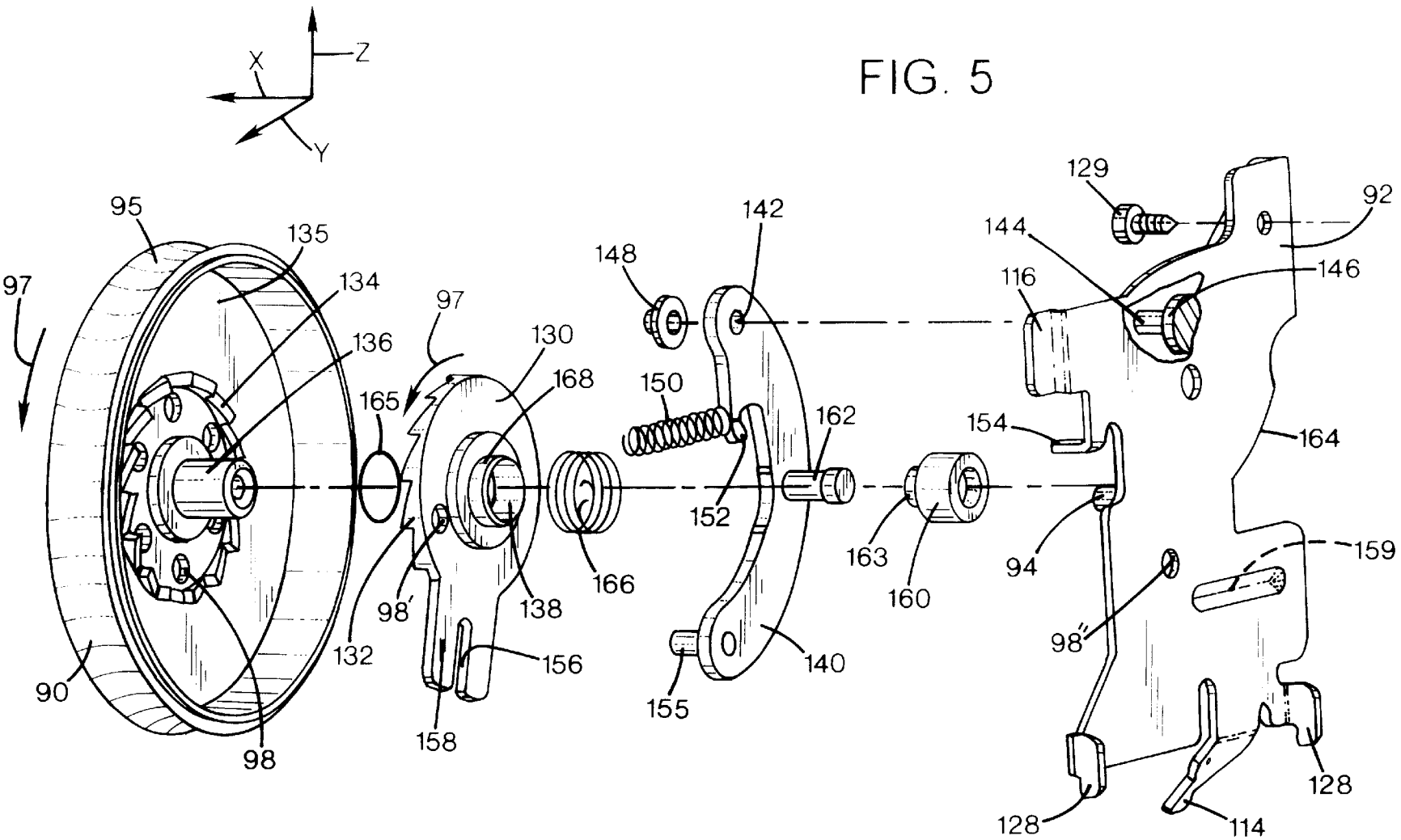
Figure 6:
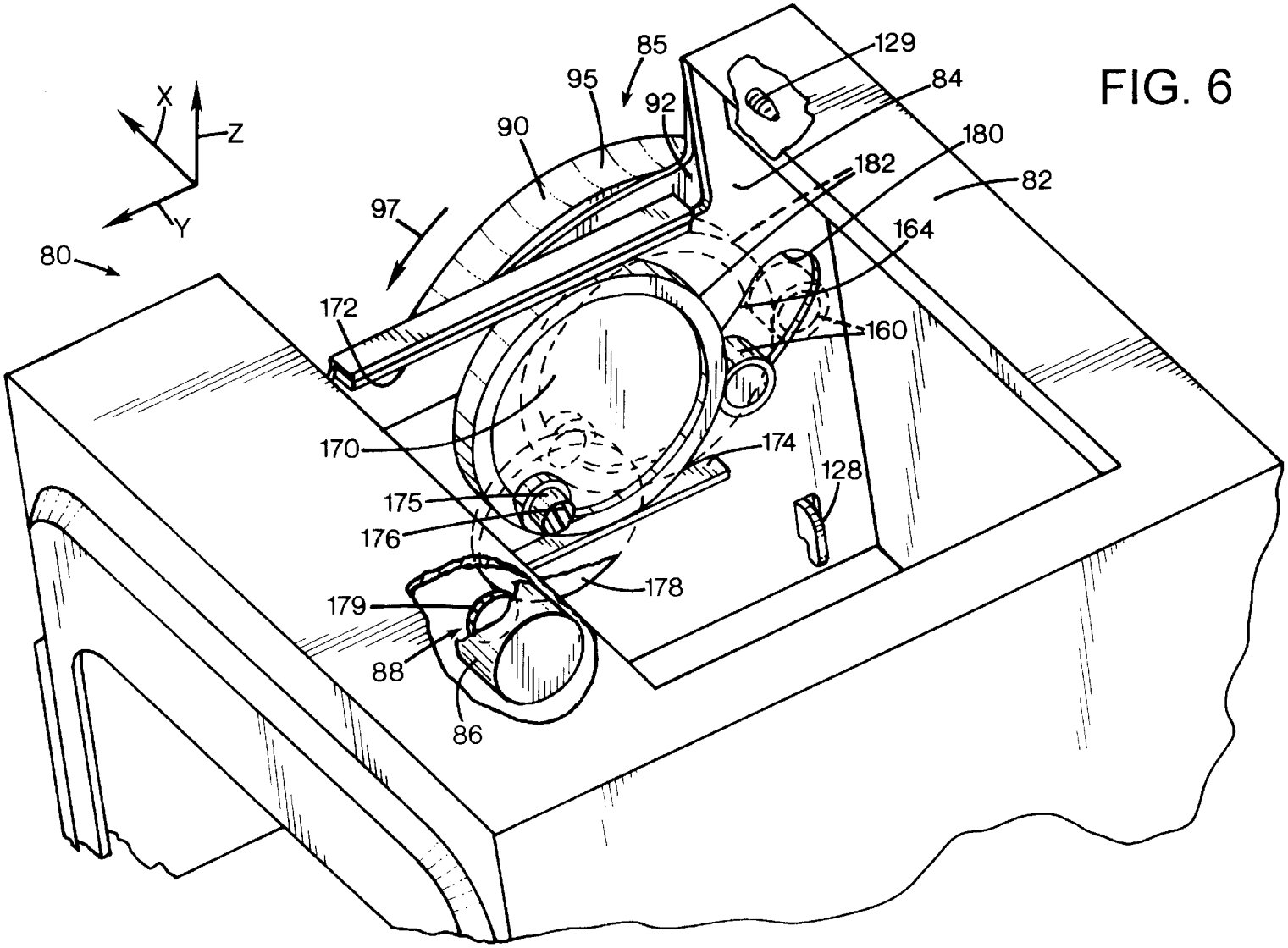
FIG. 6 is a perspective view of an interior portion of an inboard sidewall of the service station of FIG. 1, showing operation of the spittoon wheel, with an alternate operational position being shown in dashed lines.

FIGS. 4 and 5 show the construction of the spit wheel 90 along with one manner of constructing a rotating device that rotates and drives the spit wheel, while FIG. 6 shows this rotating device during operation. The spit wheel support bracket 92 is mounted to the service station frame sidewall 84 using a pair of hooks 128 which extend through holes defined by the sidewall 84, with a fastener, such as a screw 129, being used to secure the bracket 92 in place against sidewall 84. The spit wheel drive assembly includes a driver plate 130 which has a plurality of slanted or ramped ratchet teeth 132 that engage a mating set of ramped ratchet teeth 134 projecting from an interior surface 135 of the spit wheel 90 to drive the spit wheel unidirectionally, in the direction indicated by curved arrow 97. The spit wheel 90 has a hub 136 which also projects from the wheel interior surface 135. The spit wheel hub 136 extends through a bore hole 138 defined by the driver plate 130 to rotationally engage the wheel spindle or axle 94, with a fastener, such as a press fit retainer 139 (FIG. 4) being used to secure the wheel 90 to the axle 94.

To drive the driver plate 130, and in turn rotate the spit wheel 90, the drive assembly includes a ratchet arm 140. The ratchet arm 140 defines a pivot hole 142 therethrough, which is pivotally received by a pivot post 144 extending from the support bracket 92. For convenience, a spacer 146 may be used to aid unhampered movement of the ratchet arm 140, with a fastener, such as a press fit retainer 148 being used to secure the ratchet arm 140 to the pivot post 144. The ratchet arm 140 is biased into a rest position by a biasing member, such as a tension spring 150, which is coupled between a mounting finger 152 extending from the ratchet arm 140 and a stationary mounting tab 154 extending from the support bracket 92. The ratchet arm 140 also has a driver plate pin 155 projecting therefrom to engage a slot 156 defined by a radially extending arm portion 158 of the driver plate 130. The support bracket 92 may also include a ridge, such as an embossed ridge 159, which together with spacer 146 provides clearance for spring 150 to freely operate as the ratchet arm 140 pivots around post 144 without interfering with the remainder of the surface of the support bracket 92.

The spit wheel drive assembly also has a ratchet roller member 160 which is pivotally mounted to a pivot post 162 extending from the ratchet arm 140. The ratchet roller 160 has a neck portion 163 acting as a cam follower that rides along a curved cam surface 164 defined by a contoured edge of the support bracket 192. Other components included in the drive assembly include an O-ring 165 which is used to dampen the noise of engagement of the driver plate 130 and the spit wheel 90 when returning to a rest or start position. Preferably, this noise damping O-ring 165 surrounds the spit wheel hub 136 and sits against the wheel interior surface 135. To axially bias the driver plate 130 so teeth 132 engage the spit wheel teeth 134, a driver plate biasing member, such as a driver plate spring 166 is mounted to surround a boss portion 168 of the driver plate 130. This driver plate boss 168 defines bore 138. The driver plate spring 166 pushes the driver plate 130 away from the ratchet arm assembly 140 for engagement of the ratchet teeth 132 and 134.

The ratcheting action is imparted to arm 140 with a Z-direction cam portion 170 of the service station 80. The Z-cam 170 is captured along an interior surface of the sidewall 84 between an upper guide member 172 and a lower guide member 174, which are preferably formed of a low friction material, such as of a Teflon filled plastic material. The Z-cam 170 has a drive coupling sleeve 175 which receives a shaft portion 176 of a service station tumbler assembly, which raises and lowers servicing components, such as caps and wipers (not shown) from rest positions to servicing positions for servicing the printheads 70–76. Also coupled to the shaft 176 is a bull gear 178 that is driven by a pinion gear portion 179 of the drive gear assembly 88. As the pinion 179 drives the bull gear 178, this rotating movement is transformed into a revolving movement as the shaft 176 then propels the Z-cam 170 in a clockwise direction in the view of the FIG. 6.

The service station frame sidewall 84 defines a curved slot 180 through which the ratchet roller 160 extends to engage an outer periphery 182 of the Z-cam 170. In FIG. 6, the solid line representation of the Z-cam 170 is shown at the point of initial engagement with the ratchet roller 160. Further rotation of the bull gear 175 induces further clockwise rotation of the Z-cam 170, which moves the Z-cam 170 toward the rear of the inkjet printer 20, that is, toward the right in FIG. 6. During this rearward travel of the Z-cam 170, from the solid line position it to the dashed line position in FIG. 6, the spit wheel 90 is rotated in the direction of arrow 97 through approximately 45 degrees in the illustrated embodiment. This rearward travel of the Z-cam 170 pushes the ratchet arm roller 160 toward the rear, and upwardly through slot 180 as the cam follower portion 163 engages cam surface 164 of the support bracket 92. The upward movement of the ratchet arm roller 160 in slot 180 causes the ratchet arm 140 to pivot around post 144 which extends the tension spring 150. The rotation of ratchet arm 140 causes the driver pin 155 to rotate the drive plate 130 in the direction of arrow 97, which in turn, through engagement of teeth 132 with teeth 134, causes the spit wheel 90 to also rotate in the direction of arrow 97.

Recall that to the compliant scraper 125 is actively pulled into contact with the spit wheel periphery 95 by the tension spring 110. The force of the scraper 125 against wheel 90 holds the spit wheel in place as the ratchet assembly returns to a rest position, which will now be described. From the dashed line position in FIG. 6, it is apparent that further clockwise rotation of the Z-cam 170 allows the ratchet arm roller 160 to retreat in a downward direction along slot 180, under the retracting force provided by the tension spring 150 pulling on the ratchet arm 140. During this retraction stroke, the driver plate 130 is rotated in a reverse direction, opposite the arrow 97. During this reverse rotation of driver plate 130, the ramped portion of teeth ride along the ramped portions of teeth 134 on the stationary spit wheel 90, which compresses the driver plate spring 166 between the driver plate 130 and the ratchet arm 140. In the illustrated embodiment, this return stroke of the driver plate 130 retreats an arc of approximately three (3) teeth along wheel 90, before reaching a rest or start position where under the force of spring 166, teeth 132 and 134 reengage, readying the spit wheel driver assembly for the next rotational stroke.

It is apparent that a variety of other rotating devices or mechanisms may be used to rotate the spit wheel 90, and the illustrated implementation using a ratchet mechanism operated by rotation of the Z-cam 170 is merely a preferred embodiment selected by the inventors for use in service station 80 of printer 20. Indeed, a single motor may be dedicated to rotating the spit wheel 90, although the illustrated design advantageously makes use of motion provided by the motor 86 which also moves other servicing components, such as caps and wipers (not shown), between rest and servicing positions for servicing the printheads 70–76.

Figure 7:
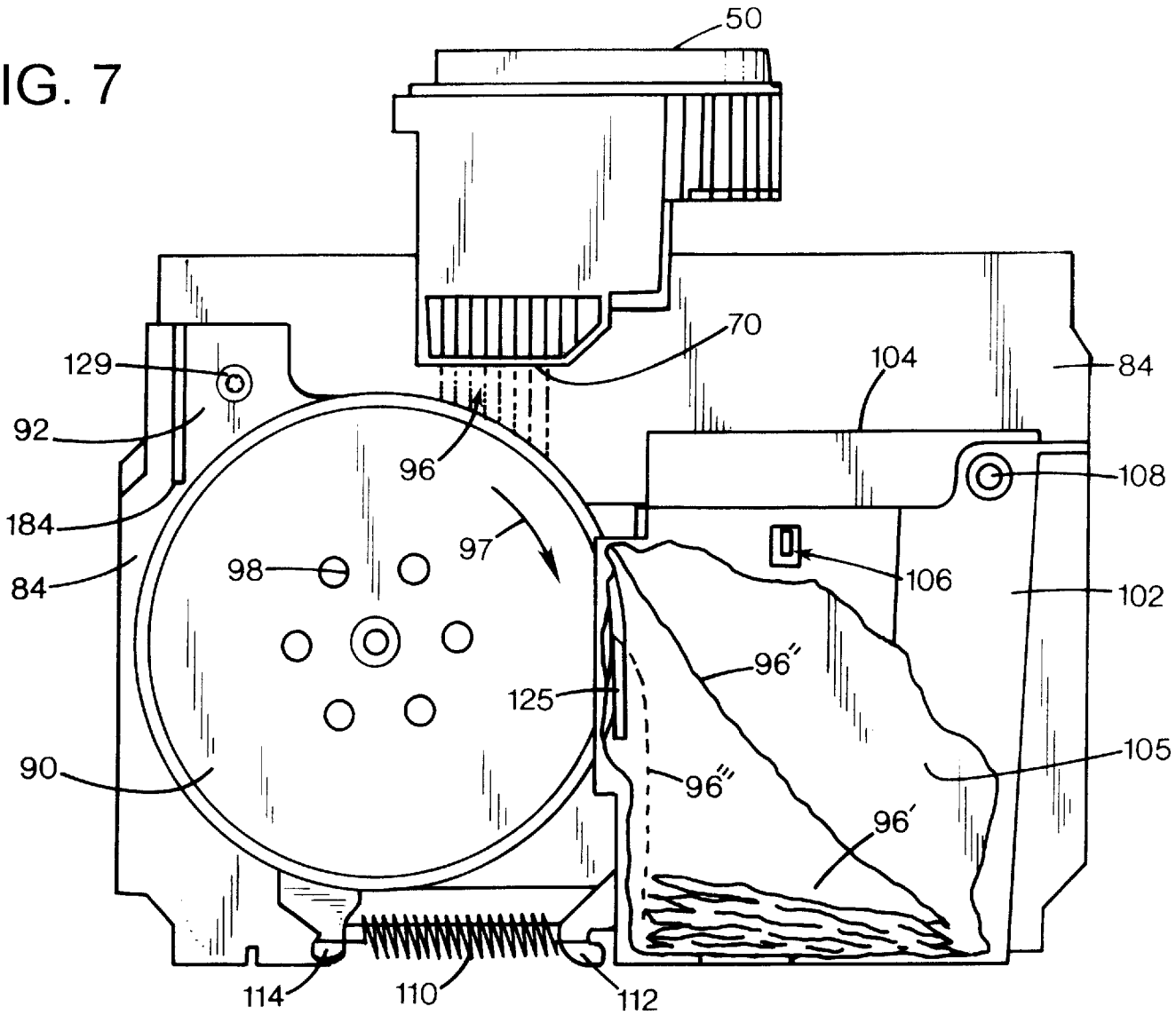
FIG. 7 is a partially fragmented side elevational view of the inboard side of the storage and spittoon system of FIG. 1, shown during printhead spitting with the printhead carriage omitted for clarity, and also showing the removal of ink residue from the spittoon wheel then storing this ink residue in a container portion of the system.

FIG. 7 shows the operation of the illustrated waste ink residue spittoon and storage system 85, where the waste ink 96 is shown being spit from the black printhead 70 onto the concave periphery 95 of the spit wheel 90. The ink residue begins to dry along the spit wheel periphery 95, to a tar-like consistency. Rotation of the spit wheel 90 in the direction of arrow 97 causes scraper 125 to remove the tar-like ink residue from the wheel periphery in a long ink residue string 96". The removal of additional ink residue by scraper 125 then pushes the previously removed residue into container 100, where the ink residue string tends to fold back and forth upon itself for a neat and efficient storage within container 100. This process of removing ink residue in a string-like fashion, followed by its subsequent packing into container 100 for permanent storage provides volumetric efficiency that handles the black ink residue accumulation over the lifespan of the printer 20.

Preferably, the wheel 90 is located so the ink spit 96 is received along the downwardly sloped portion of the wheel, which allows liquid components 96''' of the ink spit to flow under the force of gravity to bias these liquids toward the storage chamber 105 of container 100. The scraper 125 channels the majority of the liquid ink residue 96''' from the wheel periphery, allowing the liquid ink residue 96''' to drip under the force of gravity into the container chamber 105. Some of the liquid ink residue flows under scraper 125 to form a film along the wheel periphery 95. During the further rotation of the wheel 90, this film dries and then is more easily removed by scraper 125 after the next full revolution of wheel 90. Additionally, if this residue film dries to a very hard state, subsequent ink spit 96 deposited by printhead 70 over the dried film residue acts as a solvent, softening the residue for removal in the string-like fashion 96" shown in FIG. 7. If a large accumulation or globular of clump of ink inadvertently becomes stuck to the periphery of wheel 90, the ink residue handling system 85 advantageously includes a gross ink residue scraper 184, formed by a triangular shaped member extending outwardly from the spit wheel support bracket 92. This gross residue scraper 184 then removes any large ink residue accumulations which might otherwise be pulled along by the spit wheel across the face of printhead 70, a situation which could clog nozzles or extreme cases, permanently damage the printhead 70. The gross residue scraper 184 advantageously also serves as a spacer to aid in assembling the service station 80 into the interior of the printer 20, and in particular, to locate the service station frame 82 away from a portion of the chassis 22 to assure free, unhampered rotation of the spit wheel 90.

CONCLUSION

Thus, a variety of advantages are realized using the waste ink storage and spittoon system 85. For instance, the compliant nature of the scraper 125 advantageously conforms to the concave contour of the wheel rim 95, and by using an ink-resistant, non-wetting material for the scraper, ink removal is facilitated. As a further advantage, the process of cleaning the spit wheel rim 95 of ink residue may be accomplished either after the printhead carriage 45 has returned to printing in the printzone 25, or while the black printhead 70 is still spitting. The illustrated process of removing ink residue in a string-like fashion, followed by its subsequent packing into container 100 for permanent storage, provides volumetric efficiency that handles the black ink residue accumulation over the lifespan of the printer 20.

We claim:

1. A spittoon system for receiving ink residue spit from an inkjet printhead in an inkjet printing mechanism, comprising:

a storage container defining a chamber;

a rotatable spit wheel located external to the storage container, with the spit wheel having a rim located to receive ink residue spit from the inkjet printhead;

a rotating device that selectively rotates the spit wheel; and a scraper which presses against the spit wheel rim to scrape ink residue therefrom when the spit wheel is rotated, and which directs the scraped ink residue into the storage container.

2. A spittoon system according to claim 1 wherein the scraper is located for a substantially tangential contact when pressing against the rim of the spit wheel.

3. A spittoon system according to claim 1 wherein:

the rotating device rotates the spit wheel unidirectionally to define a downwardly rotating portion of the spit wheel rim during rotation; and the spit wheel is located to receive ink residue spit from the printhead along the downwardly rotating portion.

4. A spittoon system according to claim 1 wherein:

the rim of the spit wheel has a concave cross sectional shape; and the scraper is of a compliant material that conforms to the concave cross sectional shape of the spit wheel rim.

5. A spittoon system according to claim 4 wherein:

the concave cross sectional shape of the spit wheel rim channels liquid components of the ink residue toward the scraper; and the scraper is supported by the storage container to direct the liquid ink components from the spit wheel rim into the chamber of the storage container.

6. A spittoon system according to claim 1 further including a biasing member that urges the scraper to press against the rim of the spit wheel.

7. A spittoon system according to claim 6 wherein:

the scraper is supported by the storage container; and the biasing member urges the storage container toward the spit wheel to press the scraper against the rim of the spit wheel.

8. A spittoon system according to claim 1 wherein the rotating device comprises a ratchet device.

9. A spittoon system according to claim 1 wherein:

the rotating device rotates the spit wheel unidirectionally to define a downwardly rotating portion of the spit wheel rim during rotation;

the spit wheel is located to receive ink residue spit from the printhead along the downwardly rotating portion, with the rim of the spit wheel having a concave cross sectional shape that channels liquid components of the ink residue toward the scraper;

the scraper is located for a substantially tangential contact when pressing against the rim of the spit wheel, the scraper is of a compliant material that conforms to the concave cross sectional shape of the spit wheel rim, and the scraper is supported by the storage container to direct the liquid ink components from the spit wheel rim into the chamber of the storage container; and the system further includes a biasing member that urges the storage container toward the spit wheel to press the scraper against the rim of the spit wheel.

10. A method of purging ink residue from an inkjet printhead in an inkjet printing mechanism, comprising the steps of:

providing a scraper, a storage container, and a rotatable spit wheel located external to the storage container, with the spit wheel having a rim;

spitting ink residue from the printhead onto the spit wheel rim;

rotating the spit wheel;

scraping ink residue from the spit wheel rim during the rotating step; and packing the ink residue into a storage container after the scraping step.

11. A method according to claim 10 wherein:

the rotating step comprises rotating the spit wheel unidirectionally to define a downwardly rotating portion of the spit wheel rim; and the spitting step comprises spitting ink residue from the printhead onto the downwardly rotating portion of the spit wheel rim.

12. A method according to claim 10 wherein the scraping step comprises pressing a scraper into contact with the spit wheel rim at a substantially tangential orientation.

13. A method according to claim 12 further including the step of urging the scraper into contact with the spit wheel.

14. A method according to claim 10 wherein:

the providing step comprises providing a spit wheel with a rim having a concave of cross sectional shape; and the method further includes the step of channeling liquid portions of the ink residue into the storage container along the concave cross sectional shape of the rim.

15. A method according to claim 14 wherein:

the scraping step comprises pressing a scraper into contact with the spit wheel rim; and the channeling step further includes the step of directing the liquid portions of the ink residue from the spit wheel rim and into the storage container using the scraper.

16. A method according to claim 10 wherein:

the scraping step comprises removing the ink residue from the spit wheel rim as a string-like strip of ink residue; and the packing step comprises packing the string-like strip of ink residue into the storage container.

17. A method according to claim 10 wherein the method further includes the step of printing an image with the printhead during the rotating step.

18. A method according to claim 10 wherein the spitting step and the rotating step are concurrent.

19. A method according to claim 10 wherein the rotating step occurs after the spitting step.

20. A method according to claim 10 further including the step of solidifying at least a portion of the ink residue along the spit wheel rim prior to the scraping step.

21. A method according to claim 10 wherein:

the scraping step comprises pressing a scraper into contact with the spit wheel rim;

allowing a liquid portion of the ink residue to remain as an ink film on the spit wheel rim and to pass under the scraper;

drying the ink film on the spit wheel during the next revolution of the spit wheel to form a dried ink film; and removing the dried ink film in the scraping step during the next revolution of the spit wheel past the scraper.

22. An inkjet printing mechanism, comprising:

an inkjet printhead;

a carriage that carries the printhead through a printzone for printing and to a servicing region for printhead servicing; and a spittoon system located in the servicing region to receive ink residue spit from the printhead, with the spittoon system comprising:

a storage container defining a chamber;

a rotatable spit wheel located external to the storage container, with the spit wheel having a rim located to receive ink residue spit from the inkjet printhead;

a rotating device that selectively rotates the spit wheel; and a scraper which presses against the spit wheel rim to scrape ink residue therefrom when the spit wheel is rotated, and which directs the scraped ink residue into the storage container.

23. An inkjet printing mechanism according to claim 22 wherein the scraper is located for a substantially tangential contact when pressing against the rim of the spit wheel.

24. An inkjet printing mechanism according to claim 22 wherein:

the rim of the spit wheel has a concave cross sectional shape; and the scraper is of a compliant material that conforms to the concave cross sectional shape of the spit wheel rim.

25. An inkjet printing mechanism according to claim 24 wherein:

the concave cross sectional shape of the spit wheel rim channels liquid components of the ink residue toward the scraper; and the scraper is supported by the storage container to direct said liquid ink components from the spit wheel rim into the chamber of the storage container.

26. An inkjet printing mechanism according to claim 22 further including a biasing member that urges the scraper to press against the rim of the spit wheel.

27. An inkjet printing mechanism according to claim 26 wherein:

the scraper is supported by the storage container; and the biasing member urges the storage container toward the spit wheel to press the scraper against the rim of the spit wheel.

28. An inkjet printing mechanism according to claim 22 wherein the rotating device comprises a ratchet device.

29. A spittoon system for receiving ink residue spit from an inkjet printhead in an inkjet printing mechanism, comprising:

a storage container defining a chamber;

a selectively rotatable spit wheel having a rim located to receive ink residue spit from the inkjet printhead; and a scraper which contacts the spit wheel rim at a substantially tangential contact angle to scrape ink residue therefrom when the spit wheel is rotated, and which directs the scraped ink residue into the storage container.

30. A spittoon system according to claim 29 wherein:

the rim of the spit wheel has a concave cross sectional shape; and the scraper is of a compliant material that conforms to the concave cross sectional shape of the spit wheel rim.

31. A spittoon system according to claim 30 wherein:

the concave cross sectional shape of the spit wheel rim channels liquid components of the ink residue toward the scraper; and the scraper is supported by the storage container to direct the liquid ink components from the spit wheel rim into the chamber of the storage container.

32. A spittoon system according to claim 29 wherein the spit wheel is located external to the storage container.

33. A spittoon system according to claim 29 wherein:

the scraper is supported by the storage container; and the spittoon system further includes a biasing member which urges the storage container toward the spit wheel to press the scraper against the rim of the spit wheel.

* * * * *